US008487174B2

(12) United States Patent
Bentson

(10) Patent No.: US 8,487,174 B2
(45) **Date of Patent: *Jul. 16, 2013**

(54) METHOD OF INSTRUCTING AN AUDIENCE TO CREATE SPONTANEOUS MUSIC

(75) Inventor: Brian Bentson, Laguna Niguel, CA (US)

(73) Assignee: Sounds Like Fun, LLC, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/399,955

(22) Filed: Feb. 17, 2012

(65) Prior Publication Data

US 2012/0210845 A1 Aug. 23, 2012

Related U.S. Application Data

(63) Continuation of application No. 12/721,258, filed on Mar. 10, 2010, now Pat. No. 8,119,898.

(51) Int. Cl.
*G10H 7/00* (2006.01)

(52) U.S. Cl.
USPC ..... 84/609; 84/615; 84/647; 84/653

(58) Field of Classification Search
USPC ..... 84/600–602, 609, 615, 647, 649, 84/653
See application file for complete search history.

(56) References Cited

U.S. PATENT DOCUMENTS 1,940,424 A * 12/1933 Lane ..... 352/37
2,123,258 A * 7/1938 Ranger ..... 84/470 R
2,174,561 A 10/1939 Bedford
2,475,641 A * 7/1949 Rosenberg ..... 348/722
2,511,312 A * 6/1950 Wendover et al. ..... 353/29
3,787,114 A * 1/1974 Catalano et al. ..... 352/31
4,470,043 A * 9/1984 Sorensen et al. ..... 345/27
5,210,604 A * 5/1993 Carpenter ..... 348/61
5,273,437 A 12/1993 Caldwell et al.
5,563,358 A * 10/1996 Zimmerman ..... 84/477 R
5,611,174 A * 3/1997 Hayashi ..... 52/8
5,790,124 A * 8/1998 Fischer et al. ..... 345/629
5,928,057 A 7/1999 Teczynski
5,931,680 A * 8/1999 Semba ..... 434/307 A
5,993,314 A * 11/1999 Dannenberg et al. ..... 463/1
6,225,547 B1 5/2001 Toyama et al.
6,313,385 B1 11/2001 Beatty
6,390,923 B1 5/2002 Yoshitomi et al.
6,555,737 B2 4/2003 Miyaki et al.
6,987,220 B2 1/2006 Holcombe
7,385,128 B2 * 6/2008 Lawliss et al. ..... 84/484
7,485,786 B2 2/2009 Delatorre
7,521,619 B2 4/2009 Salter (Continued)

FOREIGN PATENT DOCUMENTS

KR 10-2008-0039525 A 5/2008

*Primary Examiner* — David S. Warren
(74) *Attorney, Agent, or Firm* — Klein, O'Neill & Singh, LLP

(57) ABSTRACT

A method of instructing an audience to spontaneously create music at an entertainment event is disclosed. The method comprises providing noisemakers to groups of participants, the noisemakers being distinguishable between the plurality of types and each noisemaker sounding a single note. A dynamic display comprising a screen and a notice period shows instructions to the participants. The instructions direct the participants to sound their respective noisemakers at different times. The combined sound from the various noisemakers thereby produces a musical score.

27 Claims, 8 Drawing Sheets

U.S. PATENT DOCUMENTS

| | | | | |
|---|---|---|---|---|
| 7,522,930 | B2 | 4/2009 | Inselberg | |
| 7,530,876 | B1 | 5/2009 | Wimberly | |
| 7,608,774 | B2 * | 10/2009 | Ohmura et al. | 84/470 R |
| 7,960,639 | B2 * | 6/2011 | Mizuhiki et al. | 84/622 |
| 7,982,114 | B2 * | 7/2011 | Applewhite et al. | 84/477 R |
| 8,006,899 | B2 * | 8/2011 | Wein | 235/382 |
| 8,017,854 | B2 * | 9/2011 | Foster et al. | 84/616 |
| 8,119,898 | B2 | 2/2012 | Bentson | |
| 2002/0029381 | A1 * | 3/2002 | Inselberg | 725/9 |
| 2002/0118147 | A1 | 8/2002 | Solomon | |
| 2002/0119823 | A1 * | 8/2002 | Beuscher | 463/42 |
| 2002/0165921 | A1 * | 11/2002 | Sapieyevski | 709/204 |
| 2002/0192628 | A1 | 12/2002 | Rebello | |
| 2004/0074376 | A1 * | 4/2004 | Varme | 84/483.2 |
| 2004/0206225 | A1 * | 10/2004 | Wedel | 84/477 R |
| 2005/0182504 | A1 * | 8/2005 | Bailey | 700/94 |
| 2005/0215848 | A1 | 9/2005 | Lorenzato | |
| 2005/0252362 | A1 * | 11/2005 | McHale et al. | 84/616 |
| 2005/0264472 | A1 * | 12/2005 | Rast | 345/30 |
| 2006/0009979 | A1 * | 1/2006 | McHale et al. | 704/270 |
| 2006/0112812 | A1 * | 6/2006 | Venkataraman et al. | 84/616 |
| 2006/0117937 | A1 * | 6/2006 | Lawliss et al. | 84/636 |
| 2006/0130635 | A1 * | 6/2006 | Rubang, Jr. | 84/464 A |
| 2006/0207411 | A1 * | 9/2006 | Ohmura et al. | 84/600 |
| 2006/0243119 | A1 * | 11/2006 | Rubang, Jr. | 84/609 |
| 2006/0288842 | A1 * | 12/2006 | Sitrick et al. | 84/477 R |
| 2007/0058041 | A1 | 3/2007 | Arseneau et al. | |
| 2007/0199431 | A1 * | 8/2007 | Kashioka | 84/612 |
| 2008/0184870 | A1 * | 8/2008 | Toivola | 84/610 |
| 2009/0051653 | A1 | 2/2009 | Barney et al. | |
| 2009/0087032 | A1 | 4/2009 | Boyd et al. | |
| 2009/0276292 | A1 * | 11/2009 | Inselberg | 705/10 |
| 2009/0320669 | A1 * | 12/2009 | Piccionelli | 84/609 |
| 2010/0079585 | A1 * | 4/2010 | Nemeth et al. | 348/54 |
| 2010/0207874 | A1 * | 8/2010 | Yuxin et al. | 345/156 |
| 2010/0313736 | A1 * | 12/2010 | Lenz | 84/477 R |
| 2011/0024499 | A1 * | 2/2011 | Wein | 235/382 |
| 2011/0124410 | A1 * | 5/2011 | Mao et al. | 463/31 |
| 2011/0189942 | A1 * | 8/2011 | Inselberg | 455/3.05 |
| 2011/0219939 | A1 * | 9/2011 | Bentson | 84/610 |

* cited by examiner

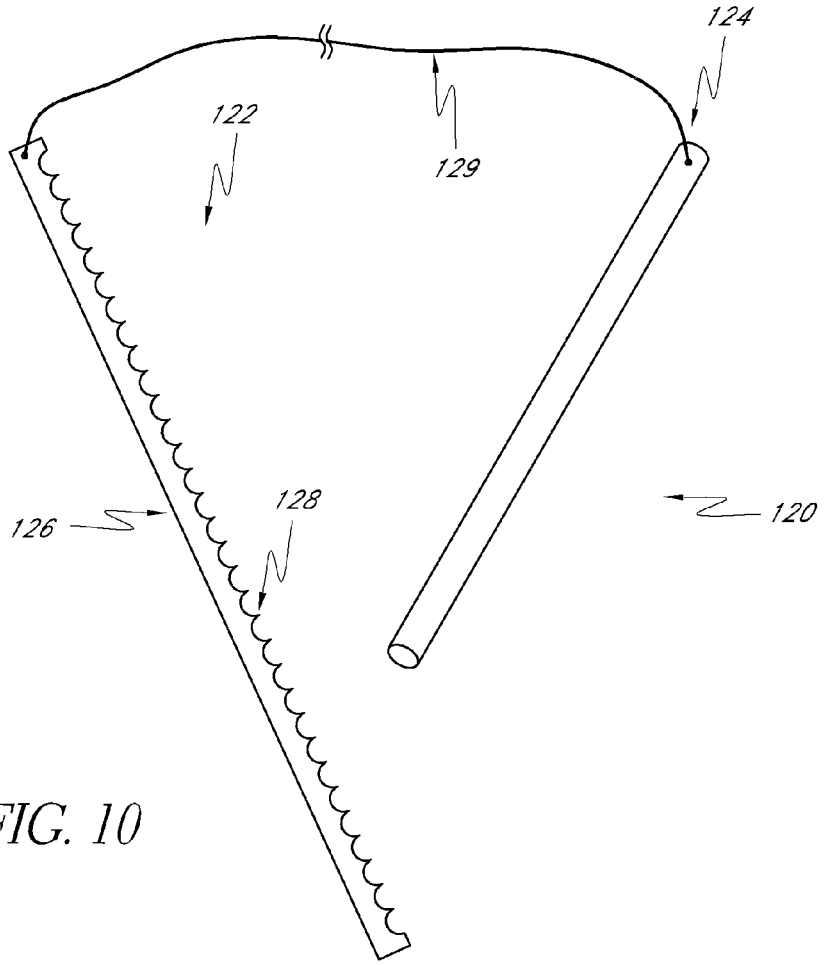
FIG. 10
FIG. 11
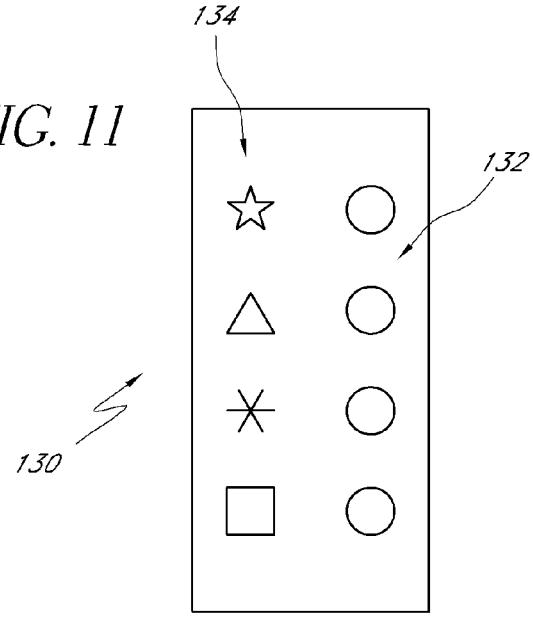

METHOD OF INSTRUCTING AN AUDIENCE TO CREATE SPONTANEOUS MUSIC

CROSS-REFERENCE TO RELATED APPLICATIONS

This Application is a continuation of U.S. patent application Ser. No. 12/721,258, filed on Mar. 10, 2010, titled METHOD OF INSTRUCTING AN AUDIENCE TO CREATE SPONTANEOUS MUSIC, the entirety of which is hereby incorporated by reference.

BACKGROUND OF THE INVENTION

1. Field of the Invention

The present invention relates to group entertainment, specifically the ability of an audience to create music without the need for rehearsal or special skills.

2. Description of the Related Art

Audience participation at entertainment events, such as a sporting event, concert or the like can increase enjoyment and engagement. Audiences are often encouraged to participate in various cheers, such as "Charge!" or "De-fence!" While most any member of the audience can take part in these cheers, they are not musical. On the other hand, fight songs or the National Anthem are examples of musical audience participation, but require practice to know the words and tune of the song, and thus can exclude some members of the audience.

Much audience participation is uncoordinated. For instance, when an audience claps each audience member claps at the time and tempo of his or her choosing. Thus, rather than a single coordinated clap, the result is a collection of individual claps. Another common example of uncoordinated audience participation is Thundersticks, which are long narrow balloons that are struck together to create a sound. Similar to clapping, each audience member chooses the time and tempo of when to strike the Thundersticks, rather than all striking at the same time to create a synchronized sound.

Nonetheless, some audience participation is coordinated, such as "The Wave." This type of audience participation involves successive portions of the audience standing-up and then immediately returning to their seat in such a way as to create the visual effect of what appears to be a wave travelling through the audience. While this cheer typically does not require practice to participate, it is non-musical. Further, since "The Wave" produces the same visual effect each time, the audience knows what to expect.

A different type of participation is found in bell choirs. These are groups of musicians that create music by the timed ringing of bells, each bell coinciding with a musical note. Although each member of the choir only controls one or some of the bells, and thus only one or some of the musical notes, the ringing of the bells in time and tempo combines to create an overall musical score. Bell choirs are organized groups that often rehearse and are generally small in the number of participants. Additionally, bell choir participants have special skills, such as the ability to read sheet music in order to know when to strike their bells.

SUMMARY

Applicant has determined that a superior method of audience participation would be one that is musical, does not require planning, rehearsal or special skills of the participants, and may produce an unforeseen result by the participants working together. Applicant has determined that a method of instructing the audience using a display in combination with audience-operated noisemakers can achieve these goals.

In one embodiment, the method comprises producing music by providing a plurality of types of noisemakers to an audience at an entertainment event and instructing the audience to sound their noisemakers at specified times. The instructions can be dynamically presented to the audience on a display or displays. The display preferably presents the instructions with a notice period, so that individual audience members can prepare and time when to sound their respective noisemakers. The instructions can direct the different types of noisemakers to be sounded at different times based on type. In this way, the different notes of the different types of noisemakers, when sounded in a prescribed time and tempo, can combine to produce music. As used herein, music, musical sequence, musical score, song or jingle refers to melody, which is a linear succession of notes that are perceived as a single entity.

The method can be used for a variety of audience sizes. In some embodiments, the audience includes at least 100 participants. In other embodiments, the audience comprises at least 1,000 participants. Still other embodiments have an audience with at least 10,000 participants.

The display that presents the instructions to the audience can be any type of dynamic display, where the term dynamic means the instructions shown on the display move relative to the confines of the display and/or the participating members of the audience. In other words, some part of the instructions travel from at least a first portion of the display to at least a second portion of the display. In some embodiments, the display is a television, LCD, plasma, LED, seven-segment display, RGB-based display, or the like. In other embodiments, the display is a scoreboard, leaderboard, or JumboTron®. Some embodiments have a display that is electronic, while others have a mechanical display, while others have a combination. In still further embodiments, the display can be a roll of paper, fabric, or the like, upon which the instructions are printed; the roll being unwound to display the instructions.

In some embodiments with multiple displays, all displays present the same instructions. But in other embodiments, different displays can present different instructions. Thus, depending on the display's location and field of view, instructions can be targeted and/or customized for certain portions of the audience based on location.

The display can be linked to or associated with a sound system. The sound system can provide portions of the music not supplied by the noisemakers. For instance, in an embodiment in which the noisemakers are all bells, the sound system can provide other sounds, such as percussion, horns, bass, guitar, vocals, and the like, in order to produce a more developed song. Additionally, the sound system can provide notes that the noisemakers do not produce. For instance, in an embodiment where the noisemakers produce the notes A, C, and D, the sound system can provide the other of the notes of the musical scale in order to produce the song. The sound system can also provide accompaniment or harmonies to the noisemakers.

The display can include a notice period. The notice period is the time from which a specific instruction first appears on the display to the time at which the instruction is to be performed. This period provides the audience members an opportunity to prepare and predict when to sound their respective noisemakers. For instance, in an embodiment with three types of noisemakers, an instruction can appear on the display to sound the first type of noisemaker several seconds before that type of noisemaker is actually to be sounded. In those seconds, those audience members with the first type of noisemaker can get ready and anticipate the point in time that they are to sound their noisemakers. The duration of the notice period can be customized to the setting and audience. In some embodiments, the notice period is about 1 to 15 seconds. Preferably, the notice period is about 2 to 5 seconds. Most preferably, the notice period is about 3 seconds.

To produce the different notes that combine to form a song, a plurality of types of noisemakers can be used. The type of noisemaker describes the musical note or sound it produces. For instance, some embodiments have three different types of noisemakers. One such embodiment has a type that produces the musical note B, a type that produces the musical note C, and a type that produces the musical note F sharp. Still other embodiments have five different types of noisemakers. One such embodiment has a different type for each of the musical notes A, B, C, D, and E flat. Yet other embodiments have other numbers of different types of noisemakers and other notes and/or sounds produced by them.

Moreover, in some embodiments, the noisemakers produce different tones, where tone means the quality of the note and/or a particular way of creating a note. For example, in one embodiment, a type of noisemaker can produce the musical note A in both the quality of a piano and the quality of a violin. Another embodiment produces the musical note B in the quality of an acoustic guitar and the quality of an electric guitar with distortion and flange effects. Tone can also refer to the pitch of a note. For instance, an embodiment has a first noisemaker that creates the musical note C and a second noisemaker that creates the same note one octave higher.

Many kinds of noisemakers can be used. Various embodiments use one or a combination of bells, horns, whistles, tuned reeds, drums, cymbals, tuning forks, clickers, pneumatic calls, electric devices, and the like. Preferably, the noisemaker is a type of idiophone.

In some embodiments, the noisemaker is a bell comprising a handle connected to a body containing a sounder. The body can be configured such that its natural frequency corresponds to a musical note. When an audience member shakes the handle the sounder strikes the body and produces the note. In some embodiments, each noisemaker makes a single note, but this is not required. Other embodiments include noisemakers that produce a plurality of notes. Some noisemakers are configured to fit in a pocket or hang from an item of clothing, jewelry, accessories, or the like.

The noisemakers can have indicia to distinguish between the plurality of types. For example, in some embodiments each type of noisemaker has a different color, so can be distinguished from the other types with other colors. Other indicia can be a letter, number, character, other symbol, picture, combinations thereof, and the like.

The method can be used in a variety of entertainment events, such as a sporting event, music concert, theatrical production, performance, and/or the like. The method can be used in a variety of venues, such as a stadium, arena, concert hall, amphitheater, and/or similar.

One of ordinary skill in the art will appreciate that the method has the advantage of creating an unexpected result. Because the display does not reveal all the musical notes of the score at one time, the method has the advantage of providing a surprise to the audience, the surprise being the resulting song. Such cooperation and discovery among the audience members is part of the fun of the method.

BRIEF DESCRIPTION OF THE DRAWINGS

FIG. 10 is a schematic view of an embodiment of a washboard-type noisemaker.

FIG. 11 is a schematic view of an embodiment of an electronic noisemaker.

DETAILED DESCRIPTION OF PREFERRED EMBODIMENTS

The present specification and figures present and discuss embodiments of a method of instructing an audience to create spontaneous music. The present specification and figures also present and discuss embodiments of a method of entertaining an audience. Embodiments of structures used in accordance with method embodiments are also described by example herein. The embodiments disclosed herein are in the context of an audience at an entertainment event, such as a sporting event. It is to be understood that the specific embodiments disclosed herein are presented as examples, and the technology and principles described herein can be applied to other configurations, technologies, and situations that involve audience participation.

Figure 1:
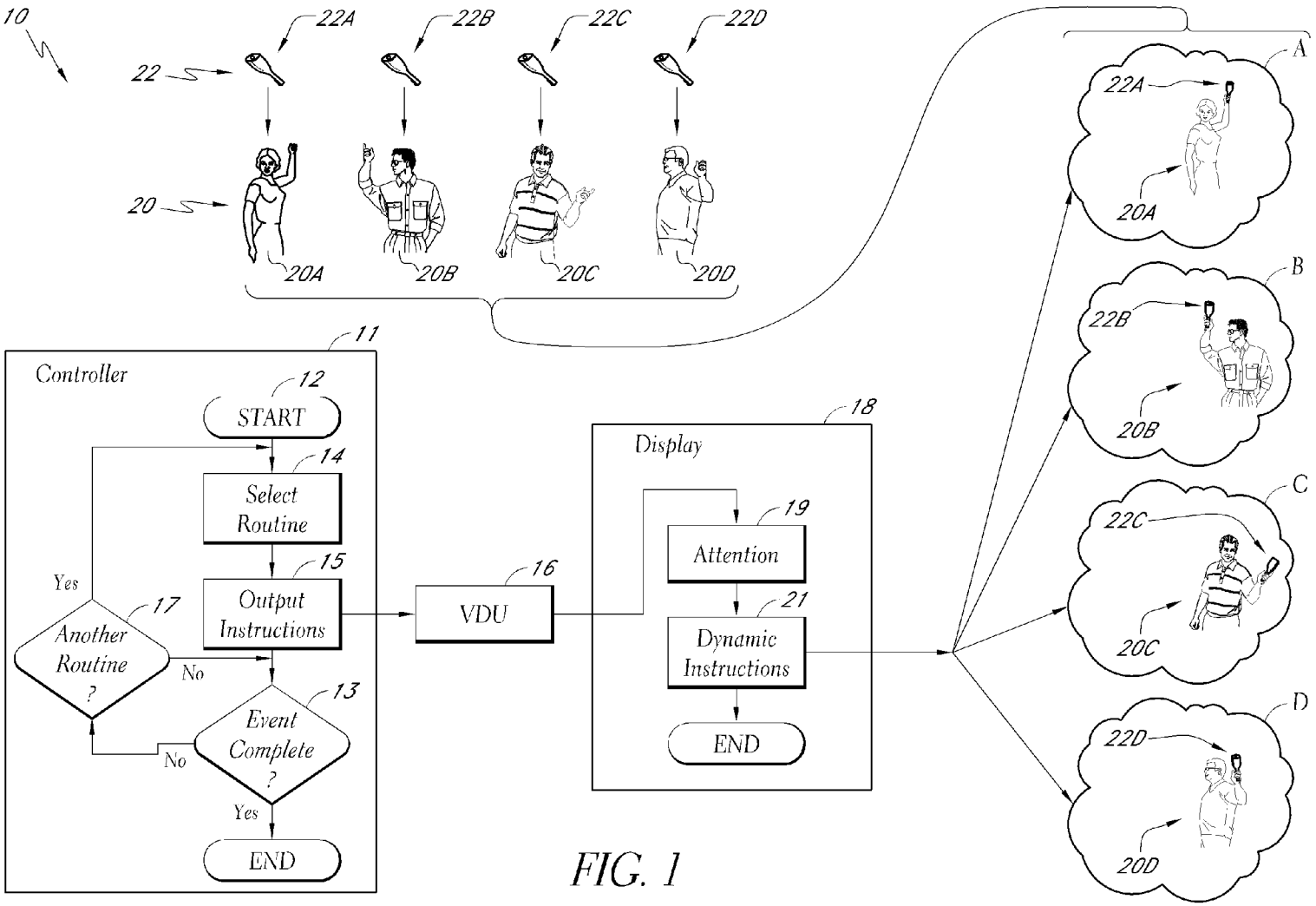
FIG. 1 is a schematic diagram illustrating a method and structure for instructing an audience to create spontaneous music in accordance with an embodiment.

FIG. 1 schematically illustrates an embodiment of a method and apparatus for instructing an audience to create spontaneous music. As shown, preferably a plurality of noisemakers 22 are provided, each of which is configured to emit a distinct musical note when sounded. The noisemakers 22 in the illustrated embodiment are depicted as bell-type noisemakers; however, it is to be understood that many types and constructions of devices that emit sound can be employed.

Noisemakers of a particular note are assigned to a respective group. The illustrated embodiment employs four noisemaker groups 22A-D, and each of the noisemakers within a particular group emits the same musical note. Also, preferably each noisemaker 22A-D bears indicia to identify its group. Such indicia may include, for example, a label, an icon, a color, combinations thereof, and the like. In one preferred embodiment, noisemakers 22A of a first group are red, noisemakers 22B of a second group are yellow, noisemakers 22C of a third group are green, and noisemakers 22D of a fourth group are blue.

The noisemakers 22 preferably are distributed to participating audience members 20, who can be considered to be differentiated into groups A-D corresponding to the particular noisemaker 22A-D they receive. Thus, a participant 20A with a red noisemaker 22A is part of group "A", a participant 20B with a yellow noisemaker 22B is part of group "B", a participant 20C with a green noisemaker 22C is part of group "C", and a participant 20D with a blue noisemaker 22D is part of group "D". Preferably, the groups 20A-D have about the same number of members, but in other embodiments the groups have disparate numbers of members.

Figure 3:
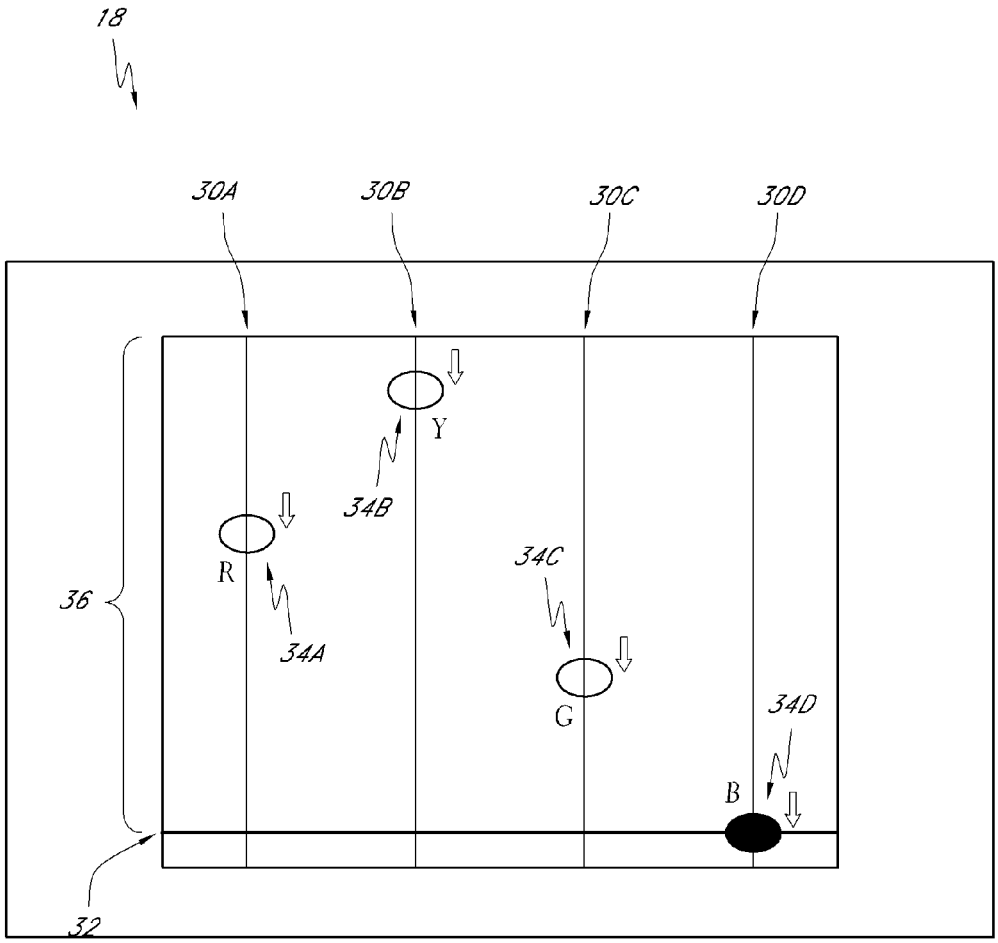
FIG. 3 illustrates an embodiment of a visual rendering of the instructions to the audience in accordance with the method and structure of FIG. 1.

With continued reference to FIG. 1 and additional reference to FIG. 3, the illustrated method and apparatus comprises a controller 11 configured to direct a display 18 to prompt and control audience instruction. In a preferred embodiment the controller 11 comprises a computer operated by an administrator and configured to selectively execute one of a plurality of musical instruction routines as selected by the administrator.

As shown, preferably the administrator initiates operation by starting 12 the control routine. A further step 14 is to select a musical routine for audience participation. Preferably the controller 11 has instructions for a plurality of musical routines stored thereon, and the administrator selects one routine from a listing of the plurality of routines. Once a routine has been selected, the controller outputs instructions 15 in order to have the routine executed. In the illustrated embodiment, the instructions are output to a video display unit 16, which converts the instructions into commands suitable to control a corresponding display 18, as will be discussed in more detail below. Once instructions have been output, the controller 11 preferably is faced with a choice 13 of whether the event is complete. If it is, the control routine ends. If the event is not complete, the administrator is queried 17 whether another musical routine is desired. When another musical routine is desired, the control routine starts again.

In the embodiment shown, the video display unit 16 receives the instructions from the controller 11, converts the instructions into commands configured to control the display 18, and outputs the commands to the display 18. For example, in a preferred embodiment the controller 11 outputs a first encoded electronic signal that the video display unit 16 receives and converts, via electronic processing, to a second encoded signal that the display 18 is configured to receive as commands. Preferably both signals are digital, but various signals and conversions are contemplated, such as digital to analog, analog to digital, digital to digital, combinations thereof, and the like. Further, although the video display unit is shown as a standalone unit, other embodiments employ a video display unit 16 that is integrated with the controller 11 or with the display 18.

With continued reference to FIG. 1, the display 18 preferably receives the output from the video display unit 16. In operation, preferably the display 18 initiates an attention step 19 to alert and/or prompt the audience to look to the display 18 for instructions. In a preferred embodiment the attention step 19 comprises a concurrent visual and audible signal, but other embodiments may employ one or the other, and may employ other ways to attract the audience's 20 attention. Preferably the display 18 then begins a dynamic instruction step 21 that, as discussed in detail below, indicates to each of the groups A-D when to ring their respective noisemakers 22A-D. Upon the completion of the dynamic instruction step 21, the musical instruction routine ends.

Figure 2:
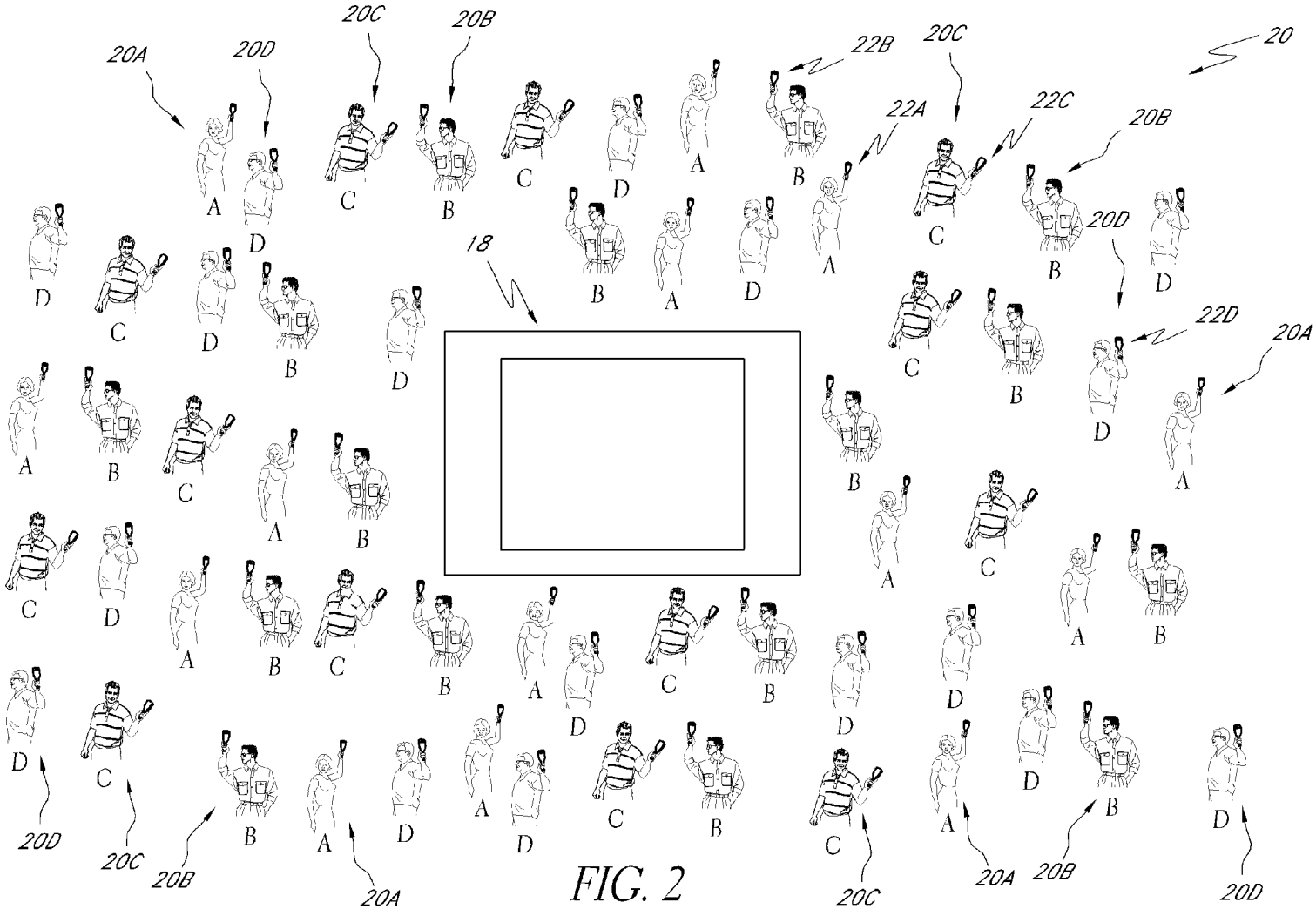
FIG. 2 is a schematic diagram illustrating an audience and a display in accordance with the method and structure of FIG. 1.

Turning to FIG. 2, the display 18 is preferably a dynamic screen that is viewable by the participating members 20 of the audience. Used herein, "dynamic" means that the instructions shown on the display move relative to the confines of the display 18 and/or the participating members of the audience 20. Preferably the display 18 is an electronic screen, such as a cathode ray tube, LED display, LCD, plasma display, RGB-based display, front end or rear projection monitor or screen, seven-segment display, or similar. More preferably, the display 18 includes both audio and visual components. For example, in one preferred embodiment, the display 18 comprises an electronic scoreboard with an integrated sound system.

With continued reference to FIG. 2, an audience 20 at an entertainment event, such as a sporting event, is illustrated. As discussed above, in the illustrated embodiment, the participating members 20A-D of the audience each hold a noisemaker 22A-D and are assigned groups A-D. The members of the groups A-D are shown intermingled in the illustrated embodiment, and the present method can operate independent of the location of individual participants. For example, as shown, a member of group A may be next to a member of group D, who may be next to a member of group C, who may be next to a member of group B. Such mixing has the advantage of producing a stereo-like effect and also does not involve the logistics of assigning participants to particular seats or particular sections of a stadium. However, in other embodiments the members of each group can be geographically gathered together.

Turning to FIG. 3, an example of a visual rendering of the instructions during the dynamic instruction 21 step is illustrated. The illustrated display 18 has a top, bottom, and opposing sides. Spaced-apart fixed paths 30A-D extend vertically from the top toward the bottom, and intersect a fixed horizontal target line 32. Each path corresponds to at least one of the groups A-D. Thus, with reference to FIGS. 1-3, path 30A is dedicated to giving instructions to group A, path 30B is dedicated to giving instructions to group B, path 30C is dedicated to giving instructions to group C, and path 30D is dedicated to giving instructions to group D. In the illustrated embodiment, the paths are continuous lines, however in other embodiments the paths are dashed, dotted, or unmarked.

To identify which path corresponds to which group, the paths 30A-D preferably include some indicia such as a label, icon, color, combinations thereof, or the like. In preferred embodiments, the indicia on the paths 30A-D and the indicia on corresponding noisemakers 22A-D are the same. For example, in one preferred embodiment, the noisemakers 22A and path 30A of the first group A are red, the noisemakers 22B and path 30B of the second group B are yellow, the noisemakers 22C and path 30C of the third group C are green, and the noisemakers 22D and path 30D of the fourth group D are blue.

With continued reference to FIG. 3, in operation a series of prompts 34A-D appear at the upper portion of the screen of the display 18 and travel along each path 30A-D toward the target line 32 at the lower portion of the display 18. Preferably, the prompts 34A-D correspond to at least one respective group A-D. Preferably each prompt 34A-D travels along the path 30A-D corresponding to the respective group A-D. Thus, with reference to FIGS. 1-3, prompt 34A on path 30A corresponds to group A, prompt 34B on path 30B corresponds to group B, and so on. Additionally, the prompts themselves may have identifying indicia. For instance, as shown in FIG. 3, the prompts 34A-D are colored red R, yellow Y, green G, and blue B, respectively, to identify them with the groups A-D corresponding to those colors.

In the illustrated embodiment, the prompts 34A-D traverse a notice distance 36 from the top of the screen to the target line 32 with sufficient speed to maintain the audience's 20 attention while also allowing adequate time for participants to predict when the prompt will reach the target line 32. To aid in predicting when a prompt will reach the target line, the prompts 34A-D preferably move at a substantially constant rate. However, it should be understood that other embodiments employ prompts that move at varying speeds. The time from when a prompt first appears on the screen to when the prompt reaches the target line 32 can be considered a notice period.

In a preferred embodiment, participants 20A-D are instructed to sound their respective noisemakers 22A-D when the prompt 34A-D corresponding to their respective group A-D contacts the target line 32. In the illustrated embodiment, when one of the prompts 34A-D reaches the target line 32, that prompt preferably undergoes a change on the display 18. Such a change highlights to the members of the group 20A-D corresponding to the changed prompt to presently sound their respective noisemaker 22A-D. In the embodiment illustrated in FIG. 3, prompts 34A-C that have not yet reached the target line 32 are shown as hollow, while prompt 34D, which is at the target line 32, has changed from hollow to filled. Thus, the display 18 is indicating that the participants of group 20D should presently sound their noisemakers 22D. Other embodiments employ other changes to a prompt reaching the target line 32, such as the prompt becoming brighter, bigger, acquiring a halo, exploding, a combination thereof, or similar. In still other embodiments, there may be no change to the prompt upon reaching the target line. Still other embodiments may or may not involve changes to the prompt upon reaching the target line, but may include other graphical or aural indicators such as a flash of a portion of the target line, appearance of additional graphics, or the like.

Preferably, as the participants 20A-D sound their respective noisemakers 22A-D as indicated by the display 18, a series of sounds results. The particularities of that series, such as the musical note of the sounds and the length of time between the sounds, are prescribed by the musical routine instructions presented on the display 18. Thus, by each group 20A-D acting independently and activating their respective noisemakers 22A-D at the prescribed time pursuant to the instructions shown on the display 18 and unique to that group, the resulting series of sounds from the noisemakers 22A-D can combine to form a single musical score.

Figure 4:
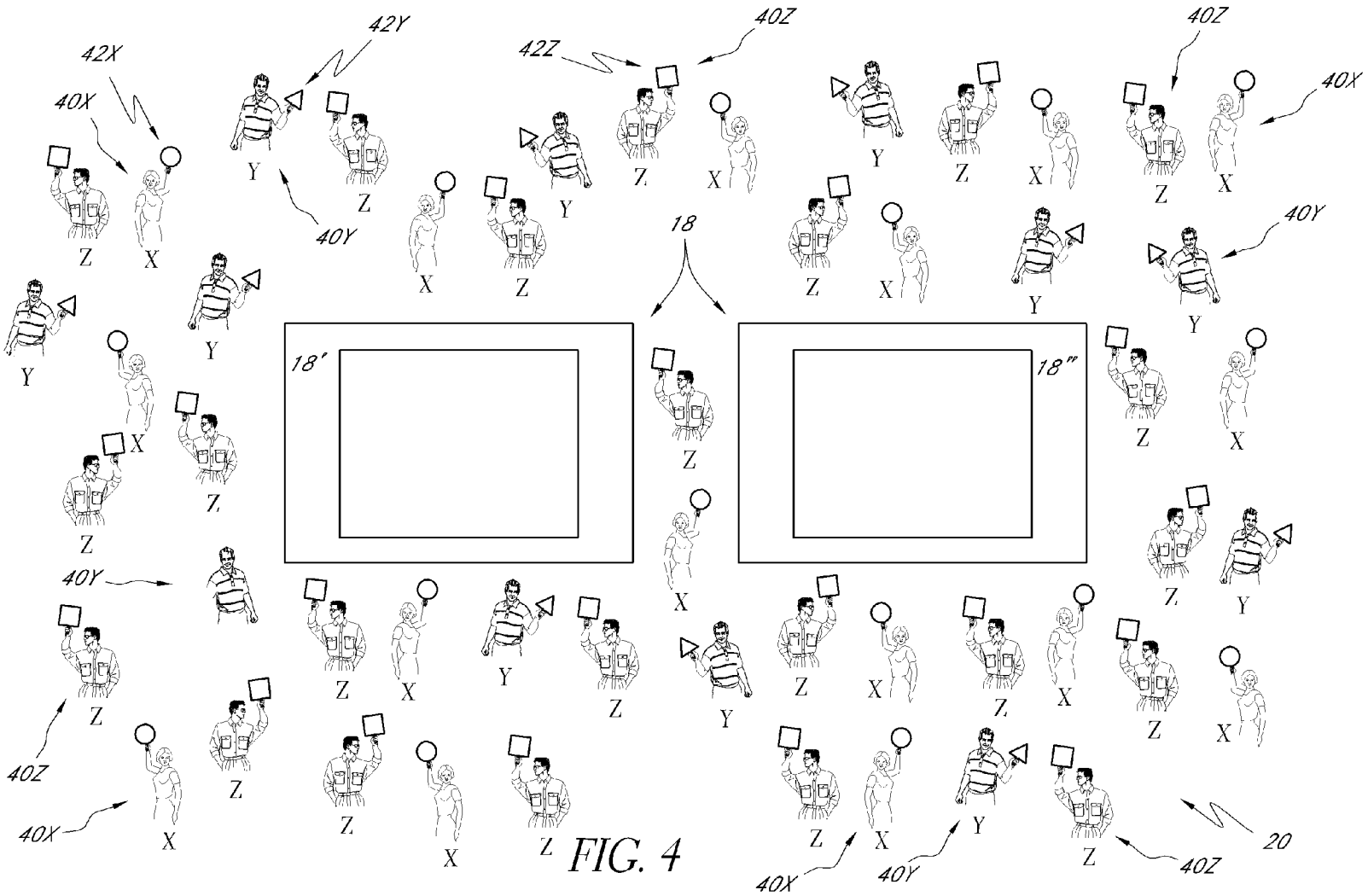
FIG. 4 is a schematic diagram illustrating an audience and a plurality of displays in accordance with another embodiment.

Turning to FIG. 4, another embodiment of a method and apparatus for instructing an audience to create spontaneous music is illustrated. In one embodiment, a plurality of noisemakers 42X-Z are disseminated among participants 40X-Z, respectively, with each noisemaker producing a musical note when sounded. The noisemakers 42X-Z are schematically illustrated as a circle, triangle, and square to indicate that the noisemakers can be different instrument types. For instance, one noisemaker can be a whistle, another a horn, and a third a chime. Having different types of noisemakers can be advantageous because the increased variety of sounds can broaden the range or flavor of playable musical scores. Further, in some embodiments the noisemakers 42X-Z comprise the same note but at different locations along the musical scale. For example, noisemaker 42X can be the musical note B, noisemaker 42Y can be the musical note B one octave higher than noisemaker 42X, and noisemaker 42Z can be the musical note B one octave lower than noisemaker 42X. This has the advantage of being able to produce agreeable chords.

Preferably, noisemakers of a particular note are assigned to a respective group. The illustrated embodiment employs three groups 40X-Z, and each of the noisemakers within each of the groups emits the same musical note. In one embodiment a plurality of types of noisemakers 42X-Z, such as a bell, a whistle, and a chime, all emit the same musical note, and thus can all be in the same group even though each emits a unique timbre corresponding to the particular type of noisemaker. Preferably each noisemaker 42X-Z bears indicia to identify its group, such as a label, icon, color, shape, combinations thereof, and the like. In one preferred embodiment, noisemakers 42X of a first group are labeled "1", noisemakers 42Y of a second group are labeled "2", and noisemakers 42Z of a third group are labeled "3".

The noisemakers 42X-Z preferably are distributed to participating audience members 20, who can be considered to be differentiated into groups 1-3 corresponding to the particular noisemaker 42X-Z they receive or provide. Thus, a participant 40X with a noisemaker 42X labeled "1" is part of group 1, a participant 40Y with a noisemaker 42Y labeled "2" is part of group 2, and a participant 40Z with a noisemaker 42Z labeled "3" is part of group 3. It will be appreciated that although three groups are shown, other embodiments employ other numbers of groups and/or numbers of types of noisemakers.

In the embodiment of FIG. 4, like in the embodiment of FIG. 1, a controller 11 (not shown) and a video display unit 16 (not shown) provide instructions to and control for the display 18. As illustrated, the display 18 can comprise a plurality of displays 18', 18" which are preferably both electronic screens. As discussed above, the participating members of the audience 20 preferably observe the display 18 for instructions on when to sound their respective noisemakers 42X-Z. As shown, the participating audience members 20 can be positioned in any orientation relative to the displays 18', 18" and may even be positioned between the displays. In some embodiments some participants view one display at a time. For example, in some embodiments, certain groups can only view one display while other groups can view only the other display. Additionally, the members of the groups can be randomly intermingled or grouped as desired.

Figure 5:
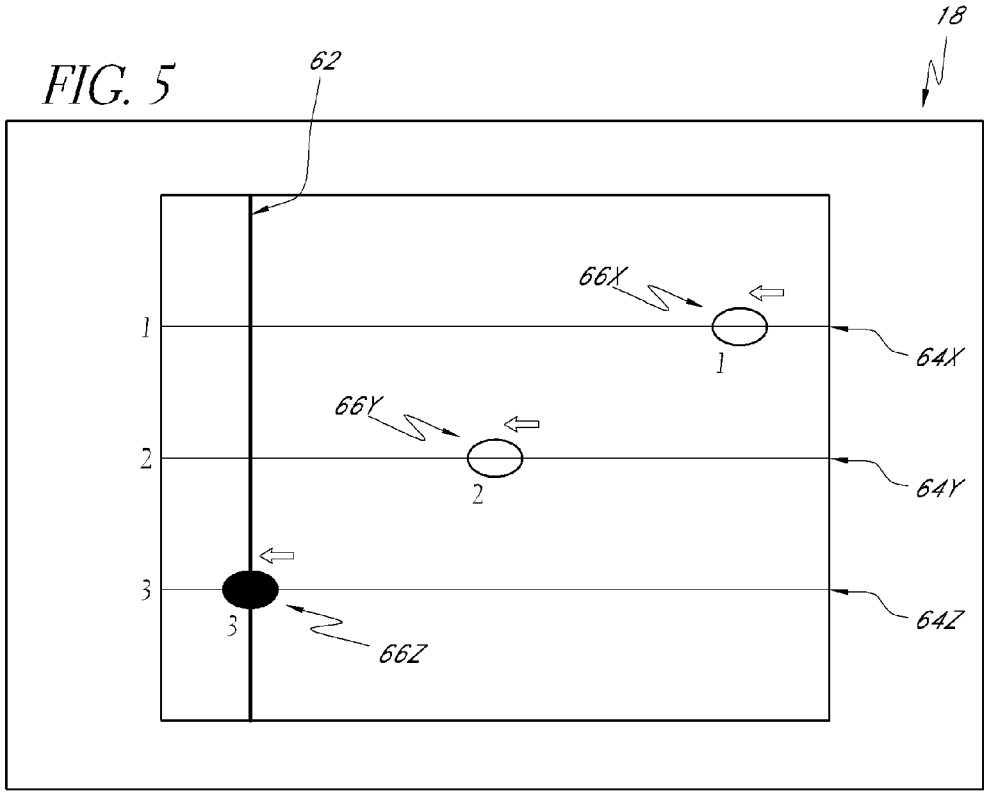
FIG. 5 illustrates an embodiment of a visual rendering of the instructions to the audience in accordance with the method and structure of FIG. 4.

FIG. 5 illustrates an example of a visual rendering of the instructions displayed on the display 18. This embodiment includes a vertical fixed target line 62 and three horizontal fixed paths 64X-Z. Preferably, a plurality of prompts 66X-Z horizontally traverse the paths 64X-Z from one side of the display 18 to the other, thus passing over the target line 62 in the process. Preferably, each of the paths 64X-Z and prompts 66X-Z have indicia to identify their corresponding group 40X-Z. For example, as shown, each of the paths 64X-Z and each of the prompts 66X-Z are labeled "1", "2", or "3", thereby identifying to each of the groups 1-3 their corresponding path and prompts.

With continued reference to FIG. 5, in one embodiment the prompts 66X-Z appear on the right of the display 18 and move to the left. As shown, prompts 66X and 66Y have appeared on the display 18, but have not reached the target line 62. On the other hand, prompt 66Z is at the target line, thereby indicating to the participants of the corresponding group (group 3) of the audience 20 that they should sound their noisemakers 42Z. As discussed above, when a prompt 66X-Z reaches the target line 62, the prompt preferably undergoes a change to highlight to the corresponding group to sound their noisemaker. Additionally, in embodiments in which the display 18 is linked to a sound system, the display 18 can play a sound to prompt and/or assist the group in sounding the note of their noisemaker.

FIG. 5 also illustrates that the display 18 preferably presents only a few prompts at a time to the audience 20. In other words, the display 18 does not concurrently reveal all of the musical notes of a song to the audience 20, nor does it display anything resembling sheet music. This is beneficial because it avoids premature identification by the audience 20 of the song to be performed and/or overwhelming an unskilled audience 20 with instructions. This promotes enjoyment, since part of the fun of the method 10 is discovering what song is being played. Also, in this embodiment, a musically unskilled member of the audience 20 doesn't need to follow sheet music or even follow the melody, but needs only to pay attention to sounding his particular noisemaker 22 when instructed. As illustrated, the display 18 reveals no more than three notes concurrently. However, other embodiments display up to four, six, ten notes or more at the same time. Of course, in the case of some short jingles the entire score may be displayed concurrently.

Figure 6:
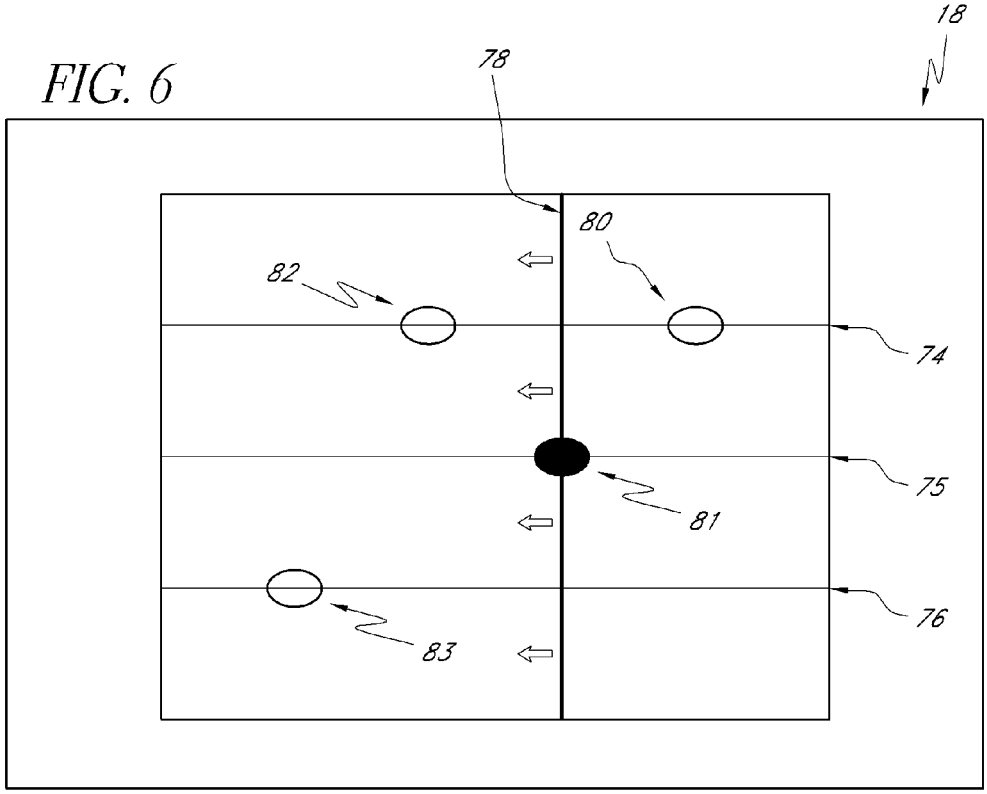
FIG. 6 illustrates another embodiment of a visual rendering of the instructions to the audience in accordance with the method and structure of FIG. 4.

Now looking to FIG. 6, another embodiment of a visual rendering of the instructions shown on the display 18 is illustrated. The illustrated embodiment has a plurality of fixed horizontal paths 74-76, a plurality of fixed prompts 80-83, and a vertical target line 78. In one embodiment, the target line 78 traverses the display 18 from one side to the other, thereby passing over the plurality of prompts 80-83 in succession. As illustrated, the target line 78 has already passed prompt 80, is presently located at prompt 81, and has not yet reached prompts 82 and 83. As in the previous embodiments discussed, the paths 74-76 and prompts 80-83 can correspond to groups in the audience 20 and have indicia to communicate that correspondence. Preferably, when the target line 78 reaches each of the prompts 80-83, the corresponding group should sound their respective noisemaker 22. For example, since the target line 78 is shown at prompt 81, the group of the audience 20 corresponding to prompt 81 should presently sound their noisemaker 22.

Figure 7:
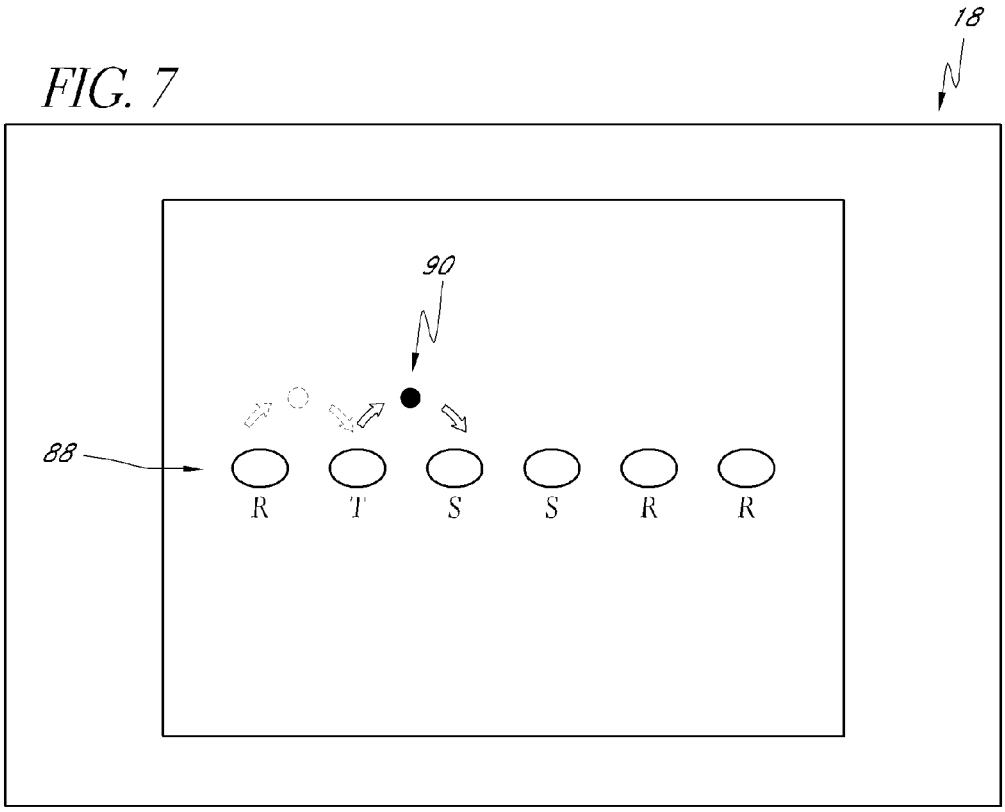
FIGS. 7-8 illustrate further embodiments of visual renderings of the instructions to the audience in accordance with the method and structure of FIGS. 1 and/or 4.

Another embodiment of the visual rendering is depicted in FIG. 7. In this embodiment, a plurality of prompts 88 are shown on the display 18. Each of the plurality of prompts 88 is preferably labeled to identify which prompts correspond to which group or groups of the audience 20. The label can be a letter, number, symbols, color, position, size, shape, intensity, or the like. In the illustrated embodiment, the prompts are labeled with the letters R, S, and T. In this embodiment, a moving target point 90 travels between each of the plurality of prompts 88. The target point 90 can be a ball, point, star, arrow, line, or similar. When the target point 90 reaches each of the plurality of prompts 88 the corresponding group of the audience 20 should sound their noisemaker 22. As discussed above, when the target reaches each prompt, the prompt preferably changes in some way, such as size, position, shape, brightness, color, combinations thereof, or the like.

Figure 8:
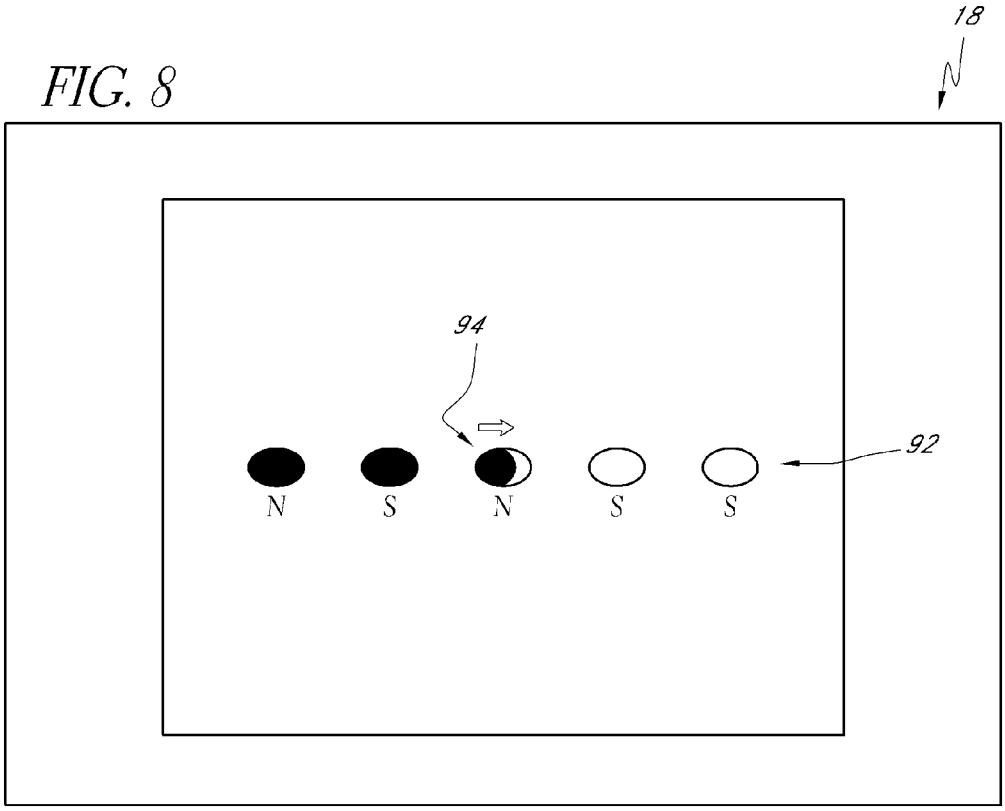

Similarly, FIG. 8 also illustrates a visual rendering of the instructions to the audience 20. As shown, the display can have a plurality of prompts 92 and indicia communicating the group or groups to which each prompt corresponds. As shown, the prompts 92 are labeled N and S, which could, for example, correspond to the north and south sides of the audience 20. In this embodiment, a swipe 94 moves across the plurality of prompts 92. In one embodiment, as the swipe reaches each of the plurality of prompts 92, the corresponding group of the audience 20 is to sound their noisemaker. The swipe 94 can be color, visibility, intensity, combinations thereof, or the like.

Although the above descriptions include an electronic display 18 to instruct the audience 20, this is not required. Rather, some embodiments comprise an analog or physical non-electronic display 18 that is presented by hand. Such embodiments preferably have a display 18 that comprises one or more signs, such as a placard or roll of paper, fabric, plastic, or the like, with the instructions (prompts) printed thereon. More preferably, the non-electronic display 18 is a scroll of paper. In implementing the method 10 in such an embodiment, an administrator first chooses the scroll 14 containing the desired instructions. The administrator provides the scroll to workers 15 who prepare it for presentation 16. The workers call for the audience's 20 attention 19 and reveal the scroll, thus displaying the instructions 21 to the audience 20. An organizer moves along the scroll and points to each of the instructions, thus indicating to the corresponding group in the audience to sound their noisemaker 22. In one embodiment, for example at a sporting event, a first cheerleader selects a scroll with prompts printed thereon and provides it to second and third cheerleaders who prepare and unfurl the scroll, thus revealing the prompts to the audience. The first cheerleader can then walk along the scroll and point to the prompts to indicate to the corresponding groups of the audience 20 when to activate their noisemaker 22. As discussed above, the resulting series of sounded noisemakers 22 can combine to create a musical score.

In another example embodiment employing a non-electronic display, a plurality of cheerleaders, each bearing indicia (such as wearing a particular color) corresponding to a particular class of noisemakers, can perform before at least a portion of the crowd, and may raise a sign, run past a target, or the like so as to indicate when a corresponding noisemaker should be sounded.

Figure 9:
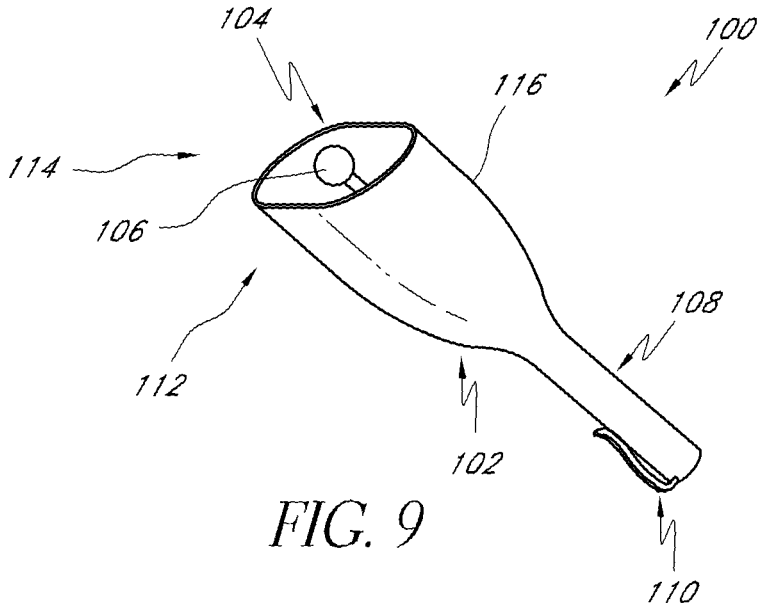
FIG. 9 is a perspective view of an embodiment of a bell-type noisemaker.

Turning now to FIGS. 9-11, embodiments of the noisemaker 22 are illustrated. One of skill in the art will recognize that these are only some of the examples of the noisemaker 22 and that other configurations are equivalent.

FIG. 9 illustrates a bell-type embodiment of a type of noisemaker 100. This embodiment comprises a body 102 with an open end 104, a sounder 106 located within the body 102, and a handle 108. As illustrated, the body 102 has a width 116 greater than the thickness 114 to facilitate stowing the noisemaker inside the pocket of clothes. However, various other shapes and sizes are contemplated. Some embodiments (not shown) comprise a substantially closed body 102, such as a rattle. The noisemaker 100 can comprise any material capable of producing a musical note when struck, such as, but not limited to, metal, ceramics, glass, plastics, wood, and the like.

The noisemaker 100 can be operated by shaking the handle 108, which moves the body 102 and causes the sounder 106 to strike the body 102, thereby stimulating a vibration in the body 102 and producing an audible note. In some embodiments, the noisemaker 100 can produce only a single musical note. But in other embodiments the noisemaker 100 can be capable or configurable to produce multiple notes.

In the illustrated embodiment, a hook-type connector 110 is provided to join the noisemaker 100 to clothing, jewelry, ribbon, chain, or the like. Other embodiments may comprise other types of connectors 110, such as a hole, magnet, hook and loop connector, adhesive, or similar. Still other embodiments do not include a connector 110. Yet further embodiments are connected to a lanyard, which can be provided with the noisemaker 100.

FIG. 10 illustrates another embodiment of a noisemaker 120, comprising a washboard 122 and a striker 124. The washboard 122 comprises a base 126 and a plurality of ridged sections 128. The noisemaker 120 is used by striking or scraping the striker 124 against or across the plurality of ridged sections 128 of the washboard 122, thereby creating a vibration in the washboard 122 and producing a desired sound. In one embodiment, the washboard 122 and striker 124 are joined by a lanyard 129, such as but not limited to, wire, string, rope, twine, or the like.

As illustrated in FIG. 11, a further embodiment of the noisemaker can comprise a electronic device 130 with one or a plurality of triggers 132 that, when activated, are configured to initiate a sound. Such a noisemaker 130 can be any type of electronic device capable of producing a musical note in conjunction with the method 10, such as but not limited to a cell phone, personal organizer, GPS device, key, keychain, synthesizer, or the like, so that the electronic device can emit a sound matching one of the groups. The illustrated noisemaker 130 has four electronic triggers 132, each with a unique label 134. As shown, the labels are a star, triangle, asterisk, and square. Such a noisemaker, like other types of multi-note noisemakers contemplated herein, could permit the user to play each of the notes falling within the tone of a particular group during the method 10.

In further embodiments, the noises produced by the electronic noisemaker 130 can be changeable and configurable based on user preferences and/or to coincide with the notes of whatever song is to be played using the method 10. In other words, the noisemaker 130 could change the notes produced by one or more of the triggers 132 to meet the needs of the notes of the song that is to be played. For example, the triggers 132 could be configured to play a first song having the notes A, B flat, C, and E and then reconfigured to play a second song with the notes A, D, E, and F sharp. In some embodiments, such a noisemaker is limited to producing notes than do not cover a full octave, while in others it is not so limited.

In embodiments discussed above, prompts are presented as moving upon a path defined by a line. In further embodiments, the path is not defined by a line or any graphical depiction. Additional embodiments are also contemplated in which prompts corresponding to more than one group are presented in one path and, in fact, multiple prompts can move along a single path at the same time. Further, embodiments discussed above have employed three or four groups. It is to be understood that more or fewer groups may be employed as desired depending on the desired complexity of both instructions and musical score.

Additionally, in some embodiments employing multiple displays, different displays may have differing instructions, so that, for example, a first group's instruction may be depicted on a first display while a second group's instruction may be depicted on a second display. Still further, in some multiple-display embodiments, one or more groups may only be able to view one of the displays, but other groups may be able to view both displays. Some such embodiments may display different instructions on the display, but with some overlap. For example, a first through fourth group's instruction may be depicted on a first display while a third through sixth group's instruction may be depicted on a second display.

In still further embodiments, the display may include aural effects that enhance or complement the music created by the participants. Additionally, some musical scores may have notes or tones that are not included in any of the groups, and the display may emit an appropriate sound so as to preserve the continuity of the musical score.

Still other embodiments may employ inputs by participants in addition to their particular noisemaker. For example, prompts as depicted above may be employed to direct participants in a particular group to sound their noisemakers at a particular time. But additional prompts may direct participants in a particular group to clap, stomp their feet, shout out a word such as "Hey" or "Go", or the like. And preferably such prompts can be intermixed with musical prompts.

Noisemakers may be provided to participants in several ways. For example, a noisemaker may be provided at the time of purchasing a ticket to an event, may be placed specifically at a seat at the venue, may be distributed randomly as attendees enter the venue, may be individually sold at or away from the venue by a venue operator or unrelated third party, and may even be made by participants. Further, an attendee's ticket may dictate the corresponding type of noisemaker, and the attendee may be given the correct noisemaker when his admission ticket is taken upon entering the venue.

In still further embodiments, noisemakers may bear a secondary insignia, such as colors or trademarks corresponding to a particular sports team, group or the like. The secondary insignia may divide attendees into subgroups or teams. In some such embodiments games may be designed encouraging the teams to compete. For example, teams could take turns playing a particular song and then be judged as to which team played it best, loudest, or the like.

It is further to be understood that features and principles discussed herein can extend beyond the particular venue. For example, many sporting events are broadcast, and many businesses (such as so-called "sports bars") remote from the venue cater to crowds of people watching the broadcast. In further embodiments, the broadcast includes the display so that remote participants can take part in the event. In further embodiments the business may generate its own display and noisemaking directions independent of the broadcast in order to liven up the broadcast event at their venue.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while several variations of the invention have been shown and described in detail, other modifications, which are within the scope of this invention, will be readily apparent to those of skill in the art based upon this disclosure. For instance, FIGS. 3 and 5-8 illustrate examples of ways to display instructions to the audience, but other configurations are possible and are contemplated. It is also contemplated that various combination or sub-combinations of the specific features and aspects of the embodiments or variations may be made and still fall within the scope of the invention. For example, the visual rendering of instructions shown in FIG. 5 could be used with the audience and grouping of FIG. 2, or the various types of noisemakers X-Z shown in FIG. 4 could be used in place of the bell-type noisemakers shown in FIG. 1. It should be understood that various features and aspects of the disclosed embodiment can be combined with or substituted for one another in order to form varying modes of the disclosed invention. Thus, it is intended that the scope of the present invention herein-disclosed should not be limited by the particular disclosed embodiments described above, but should be determined only by a fair reading of the claims that follow.

What is claimed is:

1. A system for creating spontaneous music, the system comprising:

a plurality of noisemakers comprising a first group and a second group, the first group of noisemakers configured to generate a first musical note and to be distributed to a first plurality of participants in an audience at an event, the second group of noisemakers configured to generate a second musical note and to be distributed to a second plurality of participants of the audience;

a controller comprising a computer;

a plurality of musical control routines electronically stored on the controller, the controller configured to allow an administrator to select a selected musical control routine from the plurality of the musical control routines, the controller further configured to output the selected musical control routine as instructions;

a video display unit configured to receive the instructions from the controller and to present the commands on a display as a first prompt, a second prompt, and a target, the first and second prompts configured to move relative to the target so that the first prompt meets the target at a first time and the second prompt meets the target at a second time thereby indicating to the first and second pluralities of participants when to sound the respective first and second groups of noisemakers;

wherein the first and second musical notes and the first and second times are configured so that the sounding of the first group of noisemakers with the first musical note at the first time and the sounding of the second group of noisemakers with the second musical note at the second time combine to form a desired musical work.

2. The system of claim 1, wherein the display is further configured to present the commands as a third prompt, the third prompt and the target configured to meet at a third time thereby indicating to at least one of the first and second groups of participants when to make a noise other than with the noisemakers.

3. The system of claim 2, wherein the noise other than with the noisemakers comprises a hand clap, foot stomp, or shout.

4. The system of claim 1, wherein at least the first group of noisemakers comprises a generally cylindrical element.

5. The system of claim 1, wherein at least the first group of noisemakers comprises an idiophone.

6. The system of claim 1, wherein the video display unit is integrated with the display.

7. The system of claim 1, wherein the display comprises an electronic screen in a stadium or an arena.

8. The system of claim 1, wherein the audience comprises at least 1,000 participants.

9. The system of claim 1, wherein the display is further configured to initiate an alert to the first and second pluralities of participants before presenting the first prompts, second prompts, and target.

10. The system of claim 1, wherein the display presents not more than a total of three of the first and second prompts concurrently.

11. The system of claim 1, wherein the system is configured to avoid identification of the musical work by the first and second plurality of participants prior to the first and second prompts being presented by the display.

12. The system of claim 1, wherein the display is configured to present the first and second prompts with respective notice periods, the notice periods being configured to allow the participants to predict when the first prompt will meet the target and when the second prompt will meet the target.

13. The system of claim 12, wherein the notice period comprises about 3 seconds.

14. The system of claim 1, wherein the target is generally stationary and the first and second prompts move relative to the target.

15. A method of creating spontaneous music among an audience, comprising:

designating a first plurality of participants in an audience as a first group, each participant in the first group having a first noisemaker configured to create a first tone;

designating a second plurality of participants in the audience as a second group, each participant in the second group having a second noisemaker configured to create a second tone; and instructing the first and second groups of participants with a dynamic display so as to indicate when the first and second groups of participants are to sound their respective first and second noisemakers, the dynamic display comprising a screen;

wherein instructing the first and second groups of participants comprises:

displaying a target on the screen;

displaying a first prompt on the screen, the first prompt spaced from the target;

converging the first prompt and the target until the first prompt and the target meet, a first notice period defined as the time from when the first prompt and the target begin converging until the first prompt and the target meet, the first notice period being configured to aid at least the first group of participants in predicting when the first prompt and the target will meet;

displaying a second prompt on the screen, the second prompt spaced from the target;

converging the second prompt and the target until the second prompt and the target meet, a second notice period defined as the time from when the second prompt and the target begin converging until the second prompt and the target meet, the second notice period being configured to aid at least the second group of participants in predicting when the second prompt and the target will meet; and timing the respective meetings of the first and second prompts with the target so that if the first noisemakers are sounded when the first prompt meets the target and the second noisemakers are sounded when the second prompt meets the target, a desired musical sequence is created.

16. The method of claim 15, further comprising designating the first and second groups of participants so that they are intermingled together substantially randomly.

17. The method of claim 15, further comprising indicating that at least one of the first and second groups of participants are to make a sound other than the noise generated by their respective noisemakers.

18. The method of claim 15, further comprising indicating that the first prompt corresponds with the first group of participants and the second prompt corresponds with the second group of participants.

19. The method of claim 15, further comprising providing portions of the desired musical sequence with a sound system.

20. The method of claim 15, further comprising limiting the total number of the first and second prompts displayed on the screen to six or fewer.

21. The method of claim 15, wherein the first and second notice periods are the same length of time.

22. The system of claim 1, wherein the video display unit is configured to present a first path and a second path on the display, each of the first and second paths extending across the display and intersecting the target, and wherein the first prompt moves along the first path and the second prompt moves along the second path.

23. The system of claim 22, wherein the first and second paths extend from a first edge of the display across the display and to the target.

24. The system of claim 23, wherein the first and second paths are straight.

25. The system of claim 22, wherein each prompt moves along its respective path to the target and then leaves the display.

26. The system of claim 22, wherein the first group of noisemakers cannot generate the second musical note.

27. The method of claim 15, wherein converging the first prompt and the target comprises moving the first prompt across the screen along a first path, and converging the second prompt and the target comprises moving the second prompt across the screen along a second path, and the first and second paths are spaced from one another.

* * * * *